US007762695B2

(12) United States Patent
Lanczy

(10) Patent No.: US 7,762,695 B2
(45) Date of Patent: Jul. 27, 2010

(54) LIGHT FIXTURE COUPLING SYSTEM

(75) Inventor: Geza T. Lanczy, Auburn, IN (US)

(73) Assignee: Group Dekko, Inc, Kendallville, IN (US)

( * ) Notice: Subject to any disclaimer, the term of this patent is extended or adjusted under 35 U.S.C. 154(b) by 216 days.

(21) Appl. No.: 12/052,181

(22) Filed: Mar. 20, 2008

(65) Prior Publication Data

US 2009/0237946 A1 Sep. 24, 2009

(51) Int. Cl.
*F21V 11/00* (2006.01)

(52) U.S. Cl. ..... 362/368; 362/249.01; 362/217.13; 362/217.17

(58) Field of Classification Search ..... 362/382, 362/368, 370, 374, 375, 405, 406, 407, 362, 362/249.01, 249.02, 249.07, 249.09, 249.11, 362/217.1, 217.11–217.17
See application file for complete search history.

(56) References Cited

U.S. PATENT DOCUMENTS

| | | | | |
|---|---|---|---|---|
| 4,355 | A | 4/1871 | King | |
| 1,242,242 | A | 10/1917 | Roper | |
| 2,149,844 | A | 3/1939 | George | |
| 2,199,435 | A | 5/1940 | Koonz | |
| 2,884,512 | A | 4/1959 | Wakefield | |
| 2,904,144 | A | 9/1959 | Moore | |
| 3,901,613 | A | 8/1975 | Andersson | |
| 4,358,214 | A | 11/1982 | Shull | |
| 4,413,311 | A | 11/1983 | Orenstein | |
| 4,433,363 | A * | 2/1984 | Weber | 362/86 |
| 4,952,092 | A | 8/1990 | Ballerstein | |
| 5,259,684 | A | 11/1993 | Scharer | |
| 5,678,865 | A | 10/1997 | Anderson | |
| 6,210,018 | B1 | 4/2001 | Kassay et al. | |
| 6,935,765 | B2 * | 8/2005 | Hsu | 362/405 |
| 7,217,023 | B2 | 5/2007 | Iwasa et al. | |
| 2004/0196659 | A1 * | 10/2004 | Chen | 362/405 |
| 2007/0258242 | A1 * | 11/2007 | Lin | 362/250 |

* cited by examiner

*Primary Examiner*—Bao Q Truong
(74) *Attorney, Agent, or Firm*—Taylor & Aust, P.C.

(57) ABSTRACT

A light fixture coupling system includes a plurality of lamp housings, a plurality of elongated wireways, and a mounting plate. The plurality of elongated wireways each includes a proximal end and a distal end, each of the distal ends coupled with a corresponding lamp housing. The mounting plate is positioned within each of the proximal ends, is used to couple each of the proximal ends together relative to one another, and is configured for being used to selectively move the proximal ends away from the mounting plate to align the proximal ends relative to one another.

12 Claims, 4 Drawing Sheets

LIGHT FIXTURE COUPLING SYSTEM

BACKGROUND OF THE INVENTION

1. Field of the Invention

The present invention relates to light fixtures, and, more particularly, to light fixture coupling systems.

2. Description of the Related Art

Linear light fixtures such as fluorescent lights, etc., are often used for task lighting or accent lighting. They can be mounted over work spaces and in home environments.

Various techniques are used in mounting linear light fixtures. A plurality of linear light fixtures, for instance, can be mounted so as to hang from a ceiling and couple with each other at a single junction of tubular elements of the light fixtures. Fitting the light fixtures together at the junction so that the junction appears cosmetically correct from underneath the junction, however, is problematic. Without a proper coupling of the light fixtures, the junction can have an unpleasant appearance. The junction can, for instance, appear uneven, distorted, and/or twisted.

What is needed in the art is a tube coupling system which couples a plurality of tubes together at their ends such that the junction of the tubes appears cosmetically correct, such as from underneath the tubes.

SUMMARY OF THE INVENTION

The present invention provides a tube coupling system which couples a plurality of tubes together at their ends such that the junction of the tubes appears cosmetically correct, such as from underneath the tubes.

The invention in one form is directed to a light fixture coupling system including a plurality of lamp housings, a plurality of elongated wireways, and a mounting plate. The plurality of elongated wireways each includes a proximal end and a distal end, each of the distal ends coupled with a corresponding lamp housing. The mounting plate is positioned within each of the proximal ends, is used to couple each of the proximal ends together relative to one another, and is configured for being used to selectively move the proximal ends away from the mounting plate to align the proximal ends relative to one another.

The invention in another form is directed to a tube coupling system including a plurality of tubes and a mounting plate. Each of the plurality of tubes includes a proximal end. The mounting plate is positioned within each of the proximal ends, is used to couple each of the proximal ends together relative to one another, and is configured for being used to selectively move the proximal ends away from the mounting plate to align the proximal ends relative to one another.

The invention in yet another form is directed to a method of coupling a plurality of light fixtures together, the method including the steps of providing, coupling, positioning, coupling, and aligning. The providing step provides a plurality of lamp housings and a plurality of elongated wireways each including a proximal end and a distal end. The first coupling step couples the distal ends with a corresponding lamp housing. The positioning step positions a mounting plate within each of the proximal ends. The second coupling step couples the proximal ends together relative to one another using the mounting plate. The aligning step aligns the proximal ends relative to one another by selectively moving, using the mounting plate, the proximal ends away from the mounting plate.

An advantage of the present invention is that it provides for aligning the proximal ends of the wireways, particularly the bottom walls of the wireways.

Another advantage is that the alignment is accomplished simply and inexpensively.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one embodiment of the invention, and such exemplifications are not to be construed as limiting the scope of the invention in any manner.

DETAILED DESCRIPTION OF THE INVENTION

Figure 1:
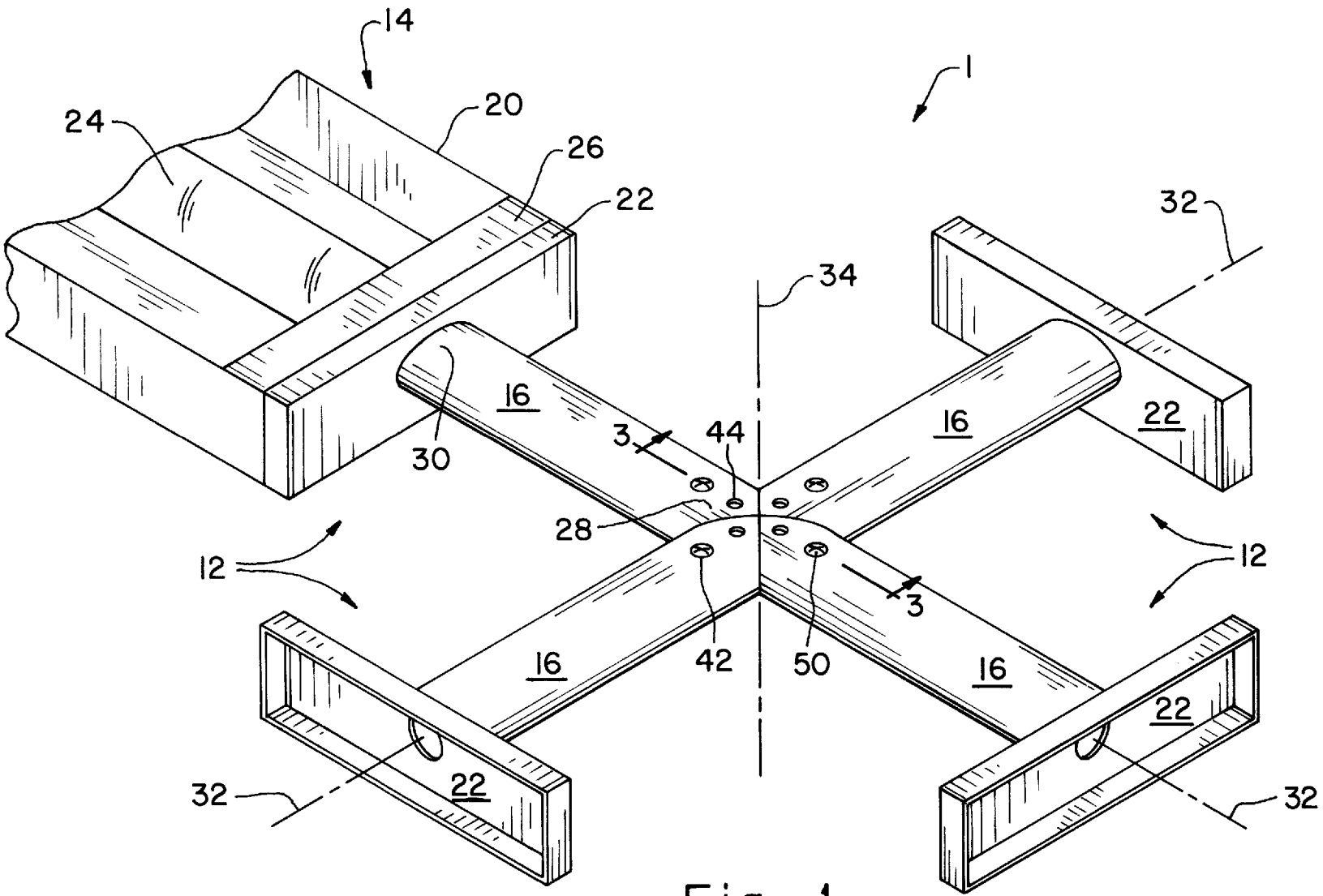
FIG. 1 is a fragmentary, top perspective view of the light fixture coupling system according to the present invention.
Figure 2:
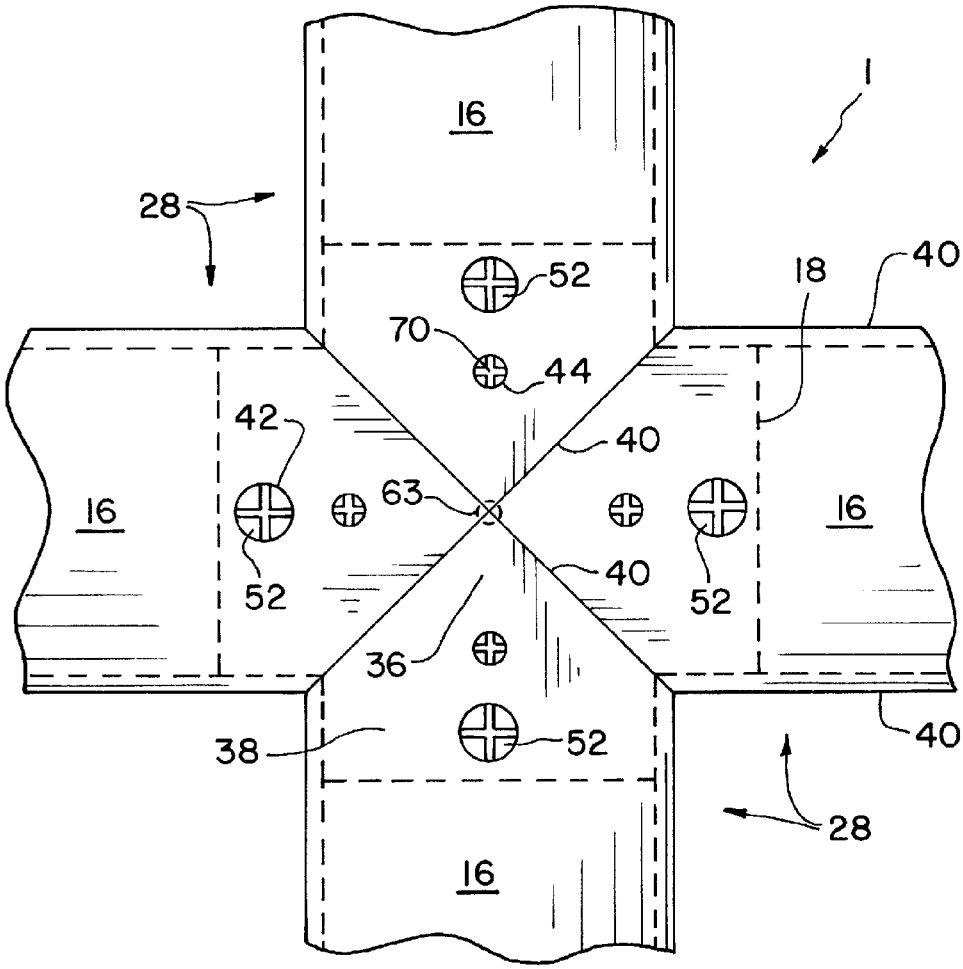
FIG. 2 is a fragmentary, top plan view of the light fixture coupling system of FIG. 1.

Referring now to the drawings, and more particularly to FIGS. 1-2, there is shown a light fixture coupling system 10 which generally includes a plurality of light fixtures 12 coupled together. While four light fixtures 12 are shown in FIG. 1, it is understood that more or less light fixtures 12 could be coupled together according to the present invention. Three, five, or more light fixtures 12 could be coupled together, for example. FIGS. 1 and 2 show that each light fixture 12 generally includes a lamp housing 14, an elongated wireway 16 (which also can be referred to as a tube 16 or a tubular element 16), and a mounting plate 18. It is understood that a description of one light fixture 12 serves as a description of the remaining light fixtures 12, as each light fixture 12 can be identical as shown in the drawings. Each light fixture 12, however, may not be identical. Further, it is noted that the present invention is not limited to light fixtures 12 but can apply generally to a system of tubes or extrusions which couple together at their proximal ends so as to form a junction which desirably appears cosmetically correct.

Lamp housing 14 can include an elongated body 20 and an endcap 22 which is coupled or formed together with body 20. Lamp housing 14 can carry a lamp 24 (such as a fluorescent lamp or a halogen lamp) and a ballast 26 coupled with lamp 24. Rather than being a ballast 26, structure 26 can be some other mounting structure which serves to mechanically and/or electrically couple lamp 24 with lamp housing 14 and/or electrical elements (such as conductors —not shown) carried by wireways 16. Only one of the lamp housings 14 in FIG. 1 shows body 20, lamp 24, and ballast 26, but it is understood that the three other lamp housings 14 also have not only an endcap 22 but also these other elements 20, 24, 26 extending from endcap 22. Body 20 can be a reflector and/or a transparent body. As a reflector, body 20 can reflect light. While lamp housing 14 is shown oriented upwardly, lamp housing 14 can be oriented, alternatively, downwardly. Further, endcap 22 and lamp housing 14 each can have a different cross-section, as opposed to the generally rectangular cross-section shown in FIG. 1; for example, the cross-section can be curved so as to be concave with the open end facing upwards.

Wireway 16 is hollow and can serve as a conduit for carrying conductors (not shown), i.e., electrical wires, from one light fixture 12 to another. Wireway 16 can taken on a variety of transverse cross-sectional shapes. As shown in the drawings, wireway 16 can have an oval transverse cross-sectional shape. Alternatively, wireway 16 can have an elliptical, a circular, a square, or a rectangular transverse cross-sectional shape, for example. Wireway 16 can also be referred to more generally as a tube. The term "tube" is meant to include such various transverse cross-sectional shapes and is not meant to be limited to oval, elliptical, or circular transverse cross-sectional shapes. Further, tube 16 can carry something (or nothing at all) other than or in addition to wires. Wireway 16 can be manufactured by extruding a suitable metal or plastic. Wireway 16 includes a proximal end 28 and a distal end 30 and has a longitudinal axis 32. Each of the proximal ends 28 are coupled together relative to one another, as shown in FIG. 1. Distal end 30 is coupled with a corresponding endcap 22 in a suitable manner, which can include fasteners, such as screws or bolts, projecting from endcap 22 and into receiving slots or holes formed in distal end 30 (not shown). Longitudinal axis 32 runs the length of wireway 16 and is generally positioned at the transverse cross-sectional center of wireway 16. The base of reference for understanding proximal and distal is a vertically oriented axis 34 (orthogonal to longitudinal axis 32, which is understood to be a horizontal axis) running through the center of the junction of proximal ends 28, as shown in FIG. 1. Proximal end 28 is nearest axis 34 relative to distal end 30.

Figure 6:
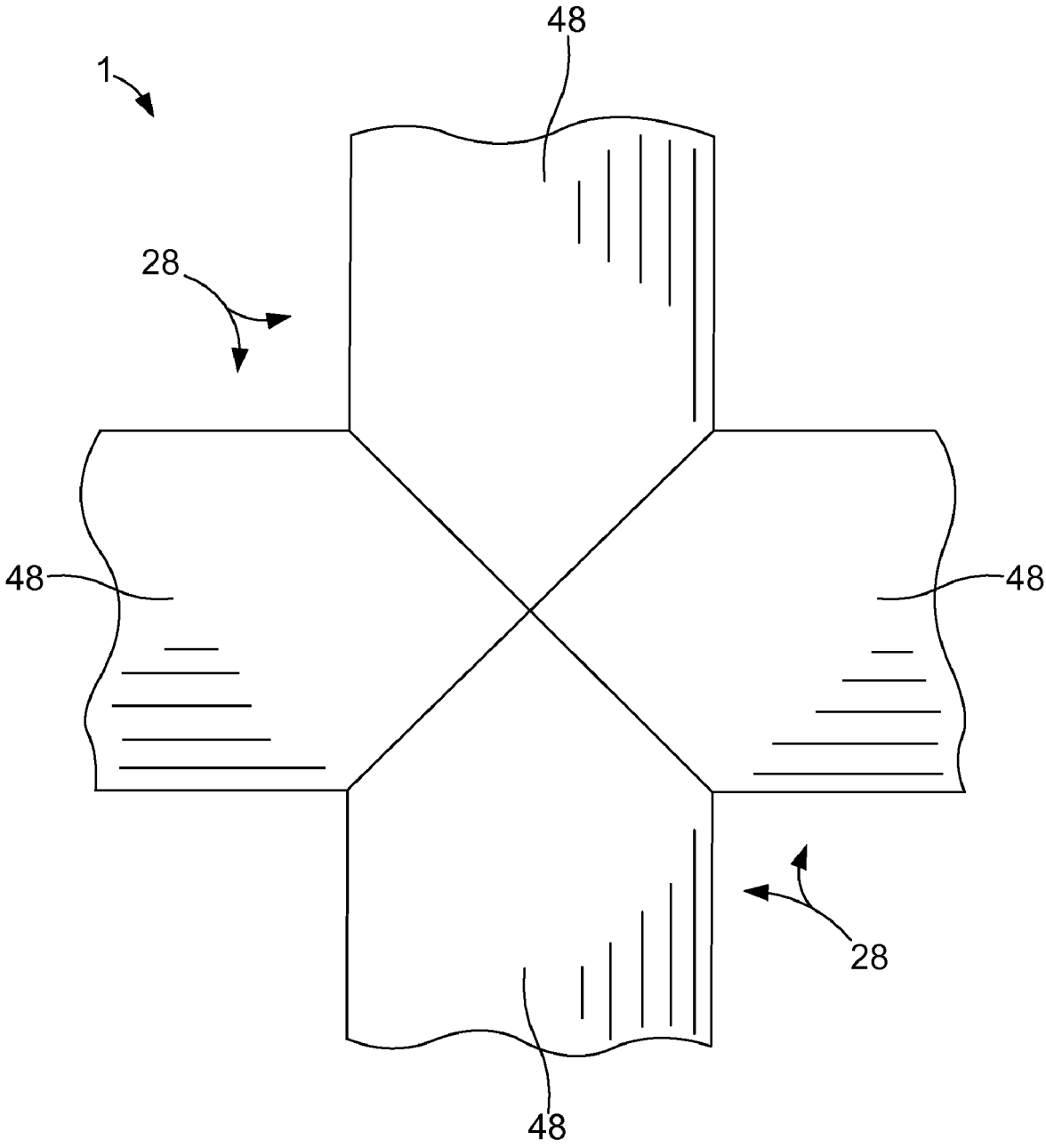
FIG. 6 is a fragmentary, bottom plan view of the light fixture coupling system of FIG. 1.

Proximal end 28 can be understood to be a proximal section which includes a triangular portion 36 and a squared portion 38. "Triangular portion" means that the opposing longitudinal sides 40, as viewed from the top or bottom of system 10 as shown in FIGS. 2 and 6, of that portion of proximal end 28 converge and ultimately meet at a point (the converging sides do not necessarily have to meet at a point). Triangular portion 36 actually includes two triangular segments, one on the top and one on the bottom of wireway. Triangular portion 36 of proximal end 28 is positioned proximally relative to squared portion 38 of proximal end 28; stated another way triangular portion 36 is positioned nearer to axis 34 than squared portion 38. Noted is that axis 34 (shown in FIG. 1) runs perpendicular to the plane of the pages in FIGS. 2 and 6 and runs through the point where the tips of the triangles of triangular portions 36 meet (i.e., through the center hole of mounting plate, the center hole being shown in broken lines in FIG. 2). "Squared portion" means that the opposing longitudinal sides 40, as viewed from the top or bottom of system 10 as shown in FIGS. 2 and 6, of that portion of proximal end 28 are generally parallel relative to one another; "squared portion" does not necessarily mean that that portion forms a cube (as a wireway 16 with an oval cross section does not form a cube).

Figure 5:
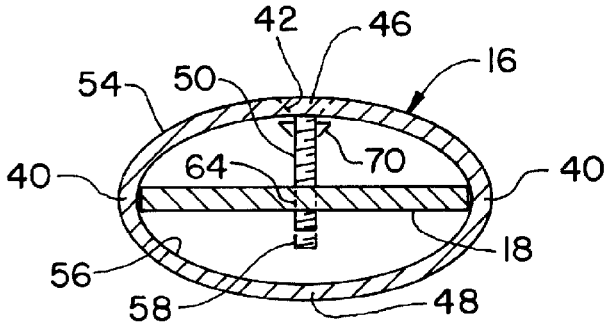
FIG. 5 is a sectional view of the light fixture coupling system taken along line 5-5 of FIG. 3.
Figure 3:
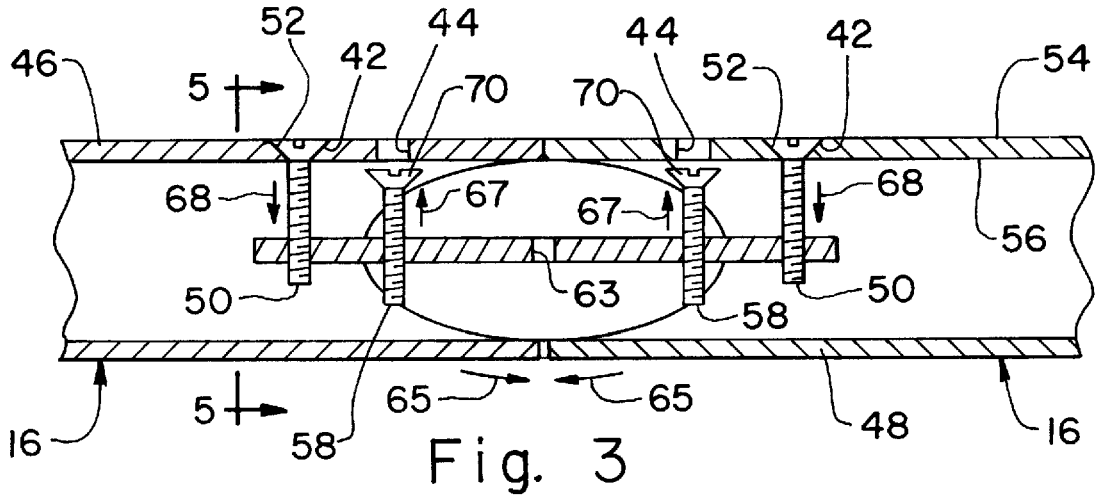
FIG. 3 is a fragmentary, sectional view of the light fixture coupling system taken along line 3-3 of FIG. 1 but showing the drawing and aligning elements in full.

Proximal end 28 defines a drawing element hole 42 and an aligning element hole 44, as shown in FIG. 3. Each hole 42, 44 is a through-hole through a top wall 46 of wireway 16 and is centered between longitudinal side walls 40 of wireway 16. While the drawings show wireway 16 as having an oval cross-section, it is understood that such an oval cross section can be understood to include top, bottom, and side walls 46, 48, 40. FIGS. 1 and 2 show top wall 46 and side walls 40 (corresponding to longitudinal sides 40) of wireway 16. FIG. 6 shows bottom wall 48 of wireway 16. FIG. 5 shows side walls 40, top wall 46, and bottom wall 48. Drawing element hole 42 is positioned in squared portion 38 of proximal end 28, as shown in FIG. 2. Drawing element hole 42 is associated with one threaded drawing element 50 and includes a chamfered edge, as shown in FIG. 3. The chamfered edge tapers moving in a downward direction toward the interior of wireway 16 and is thus shaped to matingly accommodate a screw head 52 tapering in the same direction. More specifically, the diameter of drawing element hole 42 tapers moving from a wireway outer surface 54 to a wireway inner surface 56 such that the diameter of hole 42 at outer surface 54 is larger than the diameter of hole 42 at inner surface 56.

Aligning element hole 44 is positioned in the top segment of triangular portion 36 of proximal end 28. Aligning element hole 44 is associated with one threaded aligning element 58 and does not include a chamfered edge. Rather than having a chamfered edge, the edge of aligning element hole 44 is vertical and thus matingly accommodates an imaginary cylinder therethrough. More specifically, the diameter of aligning element hole 44 remains constant running from wireway outer surface 54 to wireway inner surface 56.

Figure 4:
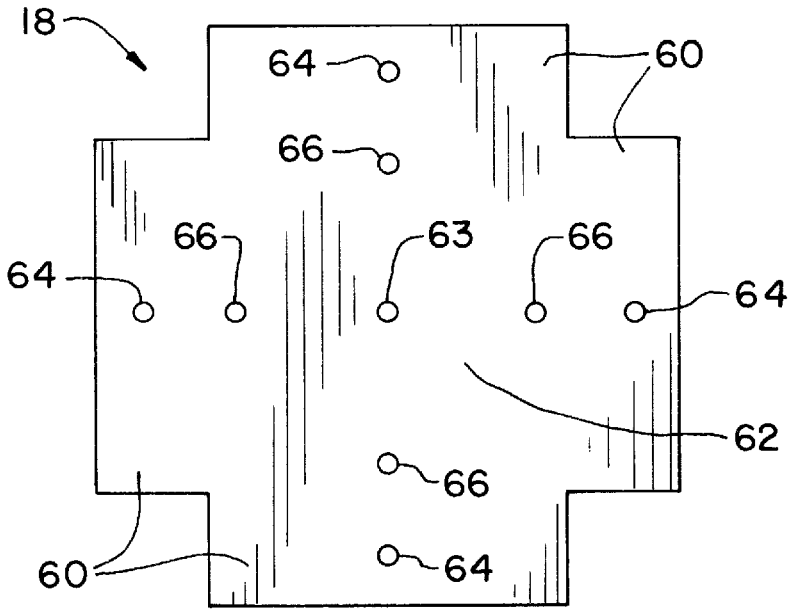
FIG. 4 is a top plan view of the mounting plate broken away from other features of the light fixture coupling system of FIG. 1.

Mounting plate 18 is positioned within each of proximal ends 28 and attached thereto, as shown in FIGS. 2, 3, and 5. FIG. 4 shows mounting plate 18 alone. Mounting plate 18 is an integral piece which serves to join the various wireways 16 together to form a junction of wireways 16. More specifically, mounting plate 18 is used to couple each proximal end 28 together relative to one another. In the embodiment shown in the drawings, mounting plate 18 works in conjunction with drawing element 50 to couple proximal ends 28 together relative to one another. Mounting plate 18 is a mounting plate at least in the sense that wireways 16 can be said to be mounted on mounting plate 18 to form the junction and in the sense that draw and aligning screws 58 are mounted on mounting plate 18. Like wireway 16, mounting plate 18 can be made of a metal or plastic. In positioning mounting plate 18 within each of the proximal ends 28, mounting plate 18 is located in the interior, in the hollow portion, of wireways 16 (that is, between top and bottom segments of triangular portion 36 and inside squared portion 38 of proximal end 28). Mounting plate 18 can be attached to proximal ends 28 of wireways 16 in a number of ways. For example, mounting plate 18 can form an interference fit with inner surface 56 of wireway 16 without using a groove in inner surface 56; in this instance, wireway 16 can have an oval transverse cross-sectional extent, for example, as shown in FIG. 5. The interference fit can be generated once threaded drawing elements 50 are tightened. Mounting plate 18 can have generally squared longitudinal edges which abut inner surface 56, as shown in FIG. 5; alternatively, mounting plate 18 can have rounded edges which matingly fits with a curved inner surface 56. Further, while FIG. 5 shows inner surface 56 as being without grooves to accommodate, in a mating fashion, the longitudinal edges of mounting plate 18, inner surface 56 could have such grooves. Alternatively, mounting plate 18 can attach to proximal ends 28 using a drawer slide type of mechanism or screw channels. Generally, a workable configuration includes one that generates a contact point that allows draw screw 50 to pull mounting plate 18 tight and still allow mounting plate 18 to pivot a bit (i.e., such pivoting or flexing can occur due to the drawing and separating action on mounting plate, as described below). As such, the present invention can include a mounting plate 18 inside of a square tube, for example, if mounting plate 18 has stand-offs (at distal portions of mounting plate 18) where draw screws 50 are received and receives aligning screws 58 inboard (proximally) of these stand-offs toward the center of mounting plate 18 (i.e., the center of the "X" of the "X-plate"—the mounting plate 18—if four light fixtures 12 are used in system 10). These examples of how mounting plate 18 attaches to each wireway proximal end 28 are not intended to be limiting.

Mounting plate 18 is configured for being used to selectively move proximal ends 28 toward and away from mounting plate 18 to align proximal ends 28 relative to one another; this movement is understood to be a relative movement of proximal ends 28 to mounting plate 18 and not necessarily that mounting plate 18 remains fixed in space while only proximal ends 28 move in space. Mounting plate 18 includes a plurality of through-holes 64, 66 which correspond to through-holes 42, 44 of proximal ends 28 of wireways 16, as shown in FIG. 3. Noted is that FIG. 5 shows drawing element hole 42 in broken lines in top wall 46, hole 64 in broken lines in mounting plate 18, as well as drawing element 50 and aligning element 58; holes 46 and 64 are shown in broken lines because they are hidden at the point where the cross-section is taken. In the embodiment of the present invention shown in the drawings, in particular FIGS. 2 and 4, mounting plate 18 forms an "X", which is understood to be a cross which is at least substantially symmetrical. If only three light fixtures 12 are used, for example, then mounting plate 18 would be a "Y-plate", rather than an "X-plate". Noted is that FIG. 2 shows mounting plate 18 and inner surface 56 of wireway 16 in broken lines, the portion of inner surface 56 shown in FIG. 2 being that which corresponds to the place where mounting plate 18 contacts, from a top view, inner surface 56; mounting plate 18 and inner surface 56 are shown in broken lines in FIG. 2 because they are hidden from view in a top plan view. FIGS. 2 and 4 show that mounting plate 18 includes four stand-offs 60 (which can also be referred to as tabs 60 or outer sections 60), as well as a single center section 62. Each tab 60 includes a through-hole 64, which corresponds to drawing element hole 42 of each wireway 16. Center section 62 includes four through-holes 66, each through-hole 66 corresponding to aligning element hole 44 of four wireways 16. Center section 62 of mounting plate 18 is situated within the area of the interior of wireways 16 which is generally bounded by, or corresponds to, triangular portion 36. Further, each tab 60 of mounting plate 18 is situated within the area of the interior of wireways 16 which is generally bounded by, or corresponds to, squared portion 38. Noted is that mounting plate 18 can include a hole 63 in the center of mounting plate 18 (though which axis 34 can run); center hole 63 is shown in FIGS. 2, 3, and 4, FIG. 2 showing center hole 63 in broken lines.

As indicated above, light fixture coupling system 10 can further include a plurality of threaded drawing elements 50 and a plurality of threaded aligning elements 58. Noted is that the cross-sectional view in FIG. 3 is taken along line 3-3 of FIG. 1, line 3-3 being taken essentially at top dead center of tube 16; however, elements 50 and 58 are shown in full in FIG. 3 (i.e., the threads of 50 and 58 are shown) and are, thus, not shown as being sliced through their center as would be expected given the positioning of line 3-3. It is understood that a description of one threaded drawing element 50 and the relationship of that threaded drawing element 50 to a corresponding wireway 16 and mounting plate 18 serves as a description of all of the threaded drawing elements 50 and their relationship to corresponding wireways 16 and mounting plate 18, unless otherwise noted. Similarly, it is understood that a description of one threaded aligning element 58 and the relationship of that threaded aligning element 58 to a corresponding wireway 16 and mounting plate 18 serves as a description of all of the threaded aligning elements 58 and their relationship to corresponding wireways 16 and mounting plate 18, unless otherwise noted. Threaded drawing element 50 and threaded aligning elements 58 are threadably received by mounting plate 18. Each threaded drawing element 50 and threaded jacking element 58 is vertically oriented.

Threaded drawing and aligning elements 50, 58 can be draw screws 50 and aligning screws 58, respectively (or, draw bolts 50 and aligning bolts 58). More specifically, each draw screw 50 is positioned within through-hole 42 of proximal end 28 and screwed at least partially into through-hole 64 of mounting plate 18. Each aligning screw 58 is positioned below, not in, through-hole 44 of proximal end 28 and screwed at least partially into through-hole 62 of mounting plate 18. Accordingly, threaded aligning element 58 is positioned proximally relative to threaded drawing element 50 of each wireway 16.

Draw screw 50 includes a head 52 and a threaded portion. The head 52 of each draw screw 50 defines grooves or the like to accommodate a screw driver therein so that the screw driver can turn the draw screw 50 when a rotation force is applied to the screw driver. Head 52 of draw screw 50 matingly seats within chamfered edge of through-hole 42 of proximal end 28, the tapering edge of through-hole 42 and the tapering head 52 of draw screw 50 preventing head 52 from falling into the interior of wireway 16 as draw screw 50 is tightened relative to mounting plate 18. Draw screw 50 tightens relative to mounting plate 18 as more of the threaded portion of draw screw 50 descends through threaded through-hole 64 of mounting plate 18, the downwardly directed arrows 68 in FIG. 3 showing the direction that draw screw 50 moves as draw screw 50 tightens relative to mounting plate 18 and also indicating that top wall 46 of proximal end 28 can move in radial direction toward mounting plate 18 and longitudinal axis 32. Stated another way, as draw screw 50 tightens relative to mounting plate 18, head 52 of draw screw 50 moves closer to mounting plate 18, and mounting plate 18 can move closer to head 52, at least until mounting plate 18 is secured against interior surface 56 of wireway 16 such that little to no additional movement upwards of mounting plate 18 is possible relative to side walls 40 of wireway 16. The tightening of draw screw 50 relative to mounting plate 18 can serve to lock mounting plate 18 in place given an oval transverse cross-section of wireway 16. Further, the tightening of each draw screw 50 relative to mounting plate 18 serves to fix and, thus, attach mounting plate 18 to the various proximal ends 28. As such, threaded drawing element 50, upon being tightened, draws proximal end 28 and mounting plate 18 toward one another. The drawing action moves mounting plate 18 toward top wall 46 of wireway 16 until mounting plate 18 contacts side walls 40 of wireway 16 and is blocked from further moving toward top wall 46 (i.e., using an interference fit), blocked at least to the extent that further movement of mounting plate 18 toward top wall 46 during tightening of draw screw 50 causes mounting plate 18 to flex, which can be possible. It is also possible to further tighten draw screw 50, upon securing mounting plate 18 to side walls 40 of wireway 16, and thereby to move top wall 46 toward mounting plate 18 (i.e., in radial direction toward longitudinal axis 32). The drawing of top wall 46 and mounting plate 18 toward each other occurs considering that head 52 of draw screw 50 is blocked from falling into interior of wireway 16 and that the threaded portion of draw screw 50 is threadably secured within mounting plate 18. As such, each threaded drawing element 50 is configured for moving corresponding proximal ends 28 toward mounting plate 18, and can also move corresponding proximal ends 28, in radial direction, toward longitudinal axis 32.

Aligning screw 58 also includes a head 70 and a threaded portion. The head 70 of each aligning screw 58 defines grooves or the like to accommodate a screw driver therein so that the screw driver can turn the aligning screw 58 when a rotation force is applied to the screw driver. Unlike head 52 of draw screw 50, head 70 of aligning screw 58 does not seat within aligning element through-hole 44 of proximal end 28 and is not positioned outside the interior of wireway 16. Rather, the outermost extent of each head 70 of threaded aligning element 58 is greater than a corresponding aligning element hole 44. Each threaded aligning element 58 is positioned radially inward of a corresponding aligning element hole 44. It is understood that "radially" includes various transverse cross-sectional shapes of proximal ends 28 of wireway 16, including square cross-sections, as well as oval, elliptical, and circular cross-sections, for example; as such, "radially" signifies the direction from a cross-sectional center point of wireway 16 to an outer edge, or perimeter, of wireway 16, or vice versa (on a similar note, longitudinal axis 32 is understood to be positioned in the radial center of tube 16). As such, each aligning screw 58 is situated in the interior of a corresponding proximal end 28. Considering that aligning screw 58 is positioned adjacent triangular portion 36 of proximal end 28 (that is, between upper and lower triangular segments of triangular portion 36), aligning screw 58 is bounded by top and bottom walls 46, 48 of wireway 16 but may not be bounded, at the same time, by left and right (when viewing wireway 16 from the top) longitudinal side walls 40 of wireway 16. Head 70 of aligning screw 58 is positioned so that it can abut inner surface 56 of proximal end 28 but does not, and cannot (given the relative diameters of head 70 and through-hole 44), extend into aligning element through-hole 44. Rather, a screw driver is inserted through aligning element hole 44 in proximal end 28 to access head 70 of aligning screw 58 and thereby can be used to cause the threaded portion of aligning screw 58 to descend or ascend relative to mounting plate 18. That is, as aligning screw 58 is screwed into mounting plate 18, head 70 of aligning screw 58 descends relative to mounting plate 18. When aligning screw 58 is turned the other way, head 70 of aligning screw 58 ascends relative to mounting plate 18. As aligning screw head 70 ascends, the top portion of aligning screw head 70 contacts and engages inner surface 56 of top wall 46 of proximal end 28 (more specifically, the top segment of triangular portion 36 of proximal end 28). Because head 70 of aligning screw 58 is greater in diameter than aligning element hole 44, head 70 does not ascend through aligning element hole 44 but, rather, abuts, engages, and presses against inner surface 56 of wireway 16 as aligning screw head 70 ascends relative to mounting plate 18. As aligning screw head 70 continues to ascend, aligning screw head 70 separates, or moves away, top wall 46 of proximal end 28 from mounting plate 18, this action helping to align bottom walls 48 with one another. In this action, it can be understood that top wall 46 is raised, or jacked, from mounting plate 18. The upwardly directed arrows 67 shown in FIG. 3 show the ascension of screw head 70 relative to mounting plate 18 as aligning screw head 70 is accordingly turned. Arrows 67 can also indicate that top wall 46 of proximal end 28 moves in radial direction away from longitudinal axis 32 of wireway 16. As such, each threaded aligning element 58 is configured for moving corresponding proximal ends 28 away from mounting plate 18 to align proximal ends 28 relative to one another, and can also move corresponding proximal ends 28, in radial direction, away from longitudinal axis 32.

In use, light fixture coupling system 10 can be assembled by first threading aligning screws 58 into aligning element through-holes 44. Then, mounting plate 18 can be positioned in each of proximal ends 28, tabs 60 of mounting plate 18 sliding into squared portions 38 of proximal ends 28, and aligning screws 58 being contained within the interior of wireway 16 or at least between the inner surfaces 56 of top and bottom segments of triangular portion 36. Upon sliding one tab 60 into one proximal end 28, a draw screw 50 can be inserted through drawing element hole 42 of that proximal end 28 and into threaded drawing element through-hole 64 of tab 60. Then, draw screw 50 can be tightened so as to attach and secure that tube 16 to mounting plate 18. The remaining wireways 16 can be similarly attached and secured to mounting plate 18 in a relatively tight fashion. Upon tightening wireways 16 to mounting plate 18 using draw screws 50, it is likely that this tightening/drawing action will have caused proximal ends 28 of wireways 16 to become deformed. More specifically, it is possible that top walls 46 of wireways 16 may contact each other while bottom walls 48 of wireways 16 may be separated from each other and form a gap therebetween, which is shown in FIG. 3. In this separated condition, bottom wall 48 of light fixture coupling system 10 has an unpleasant appearance and appears cosmetically incorrect. To rectify this separated condition and close the gap between bottom walls 48 at the junction, the aligning screw 58 of one or more wireways 16 can be turned so as to engage and thus further separate top wall 46 of wireway 16 from mounting plate 18. In so doing, bottom wall 48 moves inwardly, that is, toward axis 34 and in the direction of arrow 65 of FIG. 3. In moving bottom walls 48 in the direction of arrows 65, bottom walls 48 align. Thus, aligning screws 58 of each wireway 16 can be turned so as to move bottom wall 48 toward axis 34 and thereby to align proximal ends 28 relative to one another. In so adjusting draw and aligning elements 50, 58, the installer can move from one draw and/or aligning elements 50, 58 to the next and from one wireway 16 to the next, raising and lowering draw and/or aligning elements 50, 58 until proximal ends 28 are aligned.

When aligned, proximal ends 28 are flush together and form a junction which is correct and pleasant in appearance. With an aligned junction, light fixture coupling system 10 has a horizontal plane on its bottom wall 48 and gives the appearance that the junction is formed of a single piece of material. This aligned junction on the bottom wall 48 of light fixture coupling system 10 is shown in FIG. 6.

The present invention also provides a method of coupling a plurality of light fixtures 12 together, the method including the steps of providing, coupling, positioning, coupling, and aligning. The providing step provides a plurality of lamp housings 14 and a plurality of elongated wireways 16 each including a proximal end 28 and a distal end 30. The first coupling step couples distal ends 30 with a corresponding lamp housing 14. The positioning step positions mounting plate 18 within each proximal end 28. The second coupling step couples proximal ends 28 together relative to one another using mounting plate 18. The aligning step aligns proximal ends 28 relative to one another by selectively moving, using mounting plate 18, proximal ends 28 away from mounting plate 18. The method can further include the step of mounting plate 18 receiving a plurality of threaded aligning elements 58 and the step of turning at least one threaded aligning element 58 to move a corresponding proximal end 28 away from mounting plate 18. The method can further include the step of mounting plate 18 receiving a plurality of threaded drawing elements 50 and the step of turning at least one said threaded drawing element 50 to draw a corresponding proximal end 28 and mounting plate 18 toward one another. Each threaded aligning and drawing elements 58, 50 can be vertically oriented, threaded aligning element 58 being positioned proximally relative to threaded drawing element 50 of each wireway 16. Each proximal end 28 can define a drawing element hole 42 and an aligning element hole 44, each drawing element hole 42 being associated with one threaded drawing element 50 and including a chamfered edge, each aligning element hole 44 being associated with one threaded aligning element 58 and not including a chamfered edge. The method can further include accessing, through aligning element hole 44, a head 70 of each threaded aligning element 58, each head 70 being greater in diameter than, and positioned radially inward of, a corresponding aligning element hole 44.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A light fixture coupling system, comprising:

a plurality of lamp housings;

a plurality of elongated wireways each including a proximal end and a distal end, each of said distal ends coupled with a corresponding said lamp housing; and a mounting plate positioned within each of said proximal ends, being used to couple each of said proximal ends together relative to one another, and configured for being used to selectively move said proximal ends away from said mounting plate to align said proximal ends relative to one another.

2. The light fixture coupling system of claim 1, further including a plurality of threaded aligning elements threadably received by said mounting plate, each said threaded aligning element configured for moving a corresponding said proximal end away from said mounting plate.

3. The light fixture coupling system of claim 2, further including a plurality of threaded drawing elements threadably received by said mounting plate, each said threaded drawing element configured for drawing a corresponding said proximal end and said mounting plate toward one another.

4. The light fixture coupling system of claim 3, wherein each of said threaded aligning and drawing elements is vertically oriented, said threaded aligning element being positioned proximally relative to said threaded drawing element of each said wireway.

5. The light fixture coupling system of claim 3, wherein each said proximal end defines a drawing element hole and an aligning element hole, each said drawing element hole being associated with one said threaded drawing element and including a chamfered edge, each said aligning element hole being associated with one said threaded aligning element and not including a chamfered edge.

6. The light fixture coupling system of claim 5, wherein each said threaded aligning element includes a head which is greater in diameter than, and positioned inward of, a corresponding said aligning element hole.

7. A method of coupling a plurality of light fixtures together, said method comprising the steps of:

providing a plurality of lamp housings and a plurality of elongated wireways each including a proximal end and a distal end;

coupling said distal ends with a corresponding said lamp housing;

positioning a mounting plate within each of said proximal ends;

coupling said proximal ends together relative to one another using said mounting plate; and aligning said proximal ends relative to one another by selectively moving, using said mounting plate, said proximal ends away from said mounting plate.

8. The method of claim 7, further including the step of said mounting plate receiving a plurality of threaded aligning elements and the step of turning at least one said threaded aligning element to move a corresponding said proximal end away from said mounting plate.

9. The method of claim 8, further including the step of said mounting plate receiving a plurality of threaded drawing elements and the step of turning at least one said threaded drawing element to draw a corresponding said proximal end and said mounting plate toward one another.

10. The method of claim 9, wherein each of said threaded aligning and drawing elements is vertically oriented, said threaded aligning element being positioned proximally relative to said threaded drawing element of each said wireway.

11. The method of claim 9, wherein each said proximal end defines a drawing element hole and an aligning element hole, each said drawing element hole being associated with one said threaded drawing element and including a chamfered edge, each said aligning element hole being associated with one said threaded aligning element and not including a chamfered edge.

12. The method of claim 11, further including accessing, through said aligning element hole, a head of each said threaded aligning element, each said head being greater in diameter than, and positioned inward of, a corresponding said aligning element hole.

* * * * *